US005553936A

United States Patent [19]

Dasher et al.

[11] Patent Number: 5,553,936

[45] Date of Patent: Sep. 10, 1996

[54] SHELF LADDER FOR REFRIGERATOR OR FREEZER

[75] Inventors: James F. Dasher, Center Township, Vanderburgh County; Brian P. Kelley, Newburgh, both of Ind.

[73] Assignee: Whirlpool Corporation, Benton Harbor, Mich.

[21] Appl. No.: 96,285

[22] Filed: Jul. 26, 1993

[51] Int. Cl.[6] ..... A47B 96/04

[52] U.S. Cl. ..... 312/408; 248/243

[58] Field of Search ..... 312/408; 248/243, 248/220.1; 108/108, 107; 211/187

[56] References Cited

U.S. PATENT DOCUMENTS

| | | | |
|---|---|---|---|
| 2,297,087 | 9/1942 | Vanderveld | 248/243 |
| 3,575,484 | 4/1971 | Kesling | 312/330 |
| 3,982,801 | 9/1976 | Heidorn et al. | 312/306 |
| 4,107,833 | 8/1978 | Knight et al. | 29/460 |
| 4,190,305 | 2/1980 | Knight et al. | 312/214 |
| 4,244,637 | 1/1981 | Boorman | 248/243 |
| 4,904,032 | 2/1990 | Jenkins | 312/350 |
| 4,923,260 | 5/1990 | Poulsen | 312/214 |
| 5,004,302 | 4/1991 | Stocking et al. | 312/214 |

FOREIGN PATENT DOCUMENTS

| | | | |
|---|---|---|---|
| 0011361 | 3/1928 | Australia | 248/243 |
| 0762283 | 7/1967 | Canada | 248/243 |

*Primary Examiner*—Peter M. Cuomo
*Assistant Examiner*—Gerald A. Anderson
*Attorney, Agent, or Firm*—Thomas J. Roth; Mark A. Davis; Joel M. Van Winkle

[57] ABSTRACT

An appliance including a compartment liner having a back wall, side walls, and rounded corners connecting the back wall to the side walls includes a shelf mounting system having a linear portion secured to the back wall, a hooked portion forming one edge of the linear portion and a folded leg forming an opposite edge. Spacer members extend between the linear portion and the back wall of the liner. A vertical series of slots to receive shelf brackets is laterally offset to the outside of a vertical series of fastener apertures.

4 Claims, 2 Drawing Sheets

SHELF LADDER FOR REFRIGERATOR OR FREEZER

BACKGROUND OF THE INVENTION

1. Field of the Invention

The present invention relates to refrigeration appliances and, more particularly, to a cantilevered shelf support in a refrigeration appliance.

2. Description of the Prior Art

Refrigerator liners having large corner radii have been designed in an effort to improve the manufacturability of refrigerator liners, and to reduce the stresses in the corners of refrigerator liners, which are subject to thermal cycling. However, refrigerator liners with large corner radii incorporated into refrigeration appliances reduce the optimum shelf area of shelves mounted on shelf ladders in the refrigeration appliances.

For example, in U.S. Pat. No. 3,982,801 to Heidorn et al., the optimum shelf area is reduced by a ladder arrangement of stringer members which are provided for supporting a power-operated vertically adjustable shelf. Specifically, in order to provide sufficient space for the power-operated shelves, both the length and the width of the shelves arranged therein are limited.

U.S. Pat. No. 3,575,484 to Kesling discusses a convertible sliding shelf for a refrigerator having a curved liner. The shelf can either be supported for sliding movement on a frame, or mounted separately on the same brackets as the frame in the refrigerator. The shelf area cannot be optimized because of the need to compensate for the sliding frame along the width of the refrigerator.

The above examples illustrate that shelf area cannot be optimized using known shelving support systems.

SUMMARY OF THE INVENTION

It is an object of the present invention to provide a shelf ladder mounted on a refrigerator liner with large corner radii wherein the shelf area of shelves mounted on the shelf ladder is optimized.

This and other objects are achieved in a refrigerator including a liner having a back wall, side walls, and rounded corners connecting the back wall to the side walls. A shelf ladder is mounted to the back wall of the liner for supporting shelves within the refrigerator.

The shelf ladder is an elongated strip having a U-shaped cross section. One edge of the strip has a fold forming one leg of the U, essentially at right angles to a central portion of the strip. An opposite edge also has a fold forming the other leg of the U, but this leg is bent in or hooked to form an angle of less than 90° to the inside central portion of the strip. This second edge will be positioned adjacent to the side wall of the liner and the inward bend of the fold will allow for a long, strengthening and reinforcing leg without causing interference with the liner side wall.

The strip includes a series of slots along the length of the strip to receive shelf brackets. Two or more holes are also provided in the strip to receive fasteners for securing the strip to the liner. The slots are positioned closer to the second edge of the strip than to the first edge, while the fastener holes are positioned closer to the first edge.

A spacer is provided to surround each of the fastener holes on the back side of the strip. The spacer, which preferably is a thick cylinder secured to the strip, has a length greater than the legs of the U, so that when the strip is secured to the liner, only the spacers will engage the liner, not the legs of the strip.

DETAILED DESCRIPTION

Figure 1:
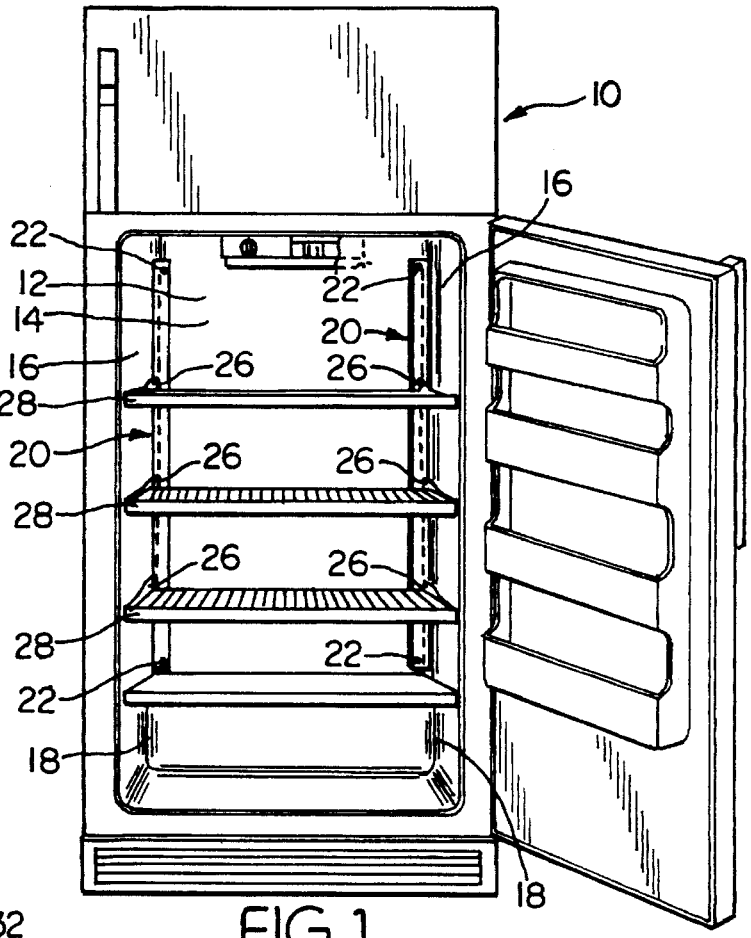
FIG. 1 is a front view of a refrigeration appliance constructed in accordance with the principles of the present invention.

As illustrated in FIG. 1, a refrigeration appliance 10 constructed in accordance with the principles of the present invention includes a liner 12 having a back wall 14 and side walls 16. The side walls 16 are connected to the back wall 14 by rounded corners 18 having a large radius, on the order of 15–20 mm. The sweep of the large corner radius defines a 90° arc angle area. A shelf ladder 20 in the form of an elongated member is mounted vertically to the liner 12 by a number of mounting screws 22. The shelf ladder 20 includes a number of vertical slots 24. A number of shelf mounting brackets 26 forming lateral side walls of a shelf 28 are secured in slots 24 to support the shelves within the refrigeration appliance 10.

Figure 2:
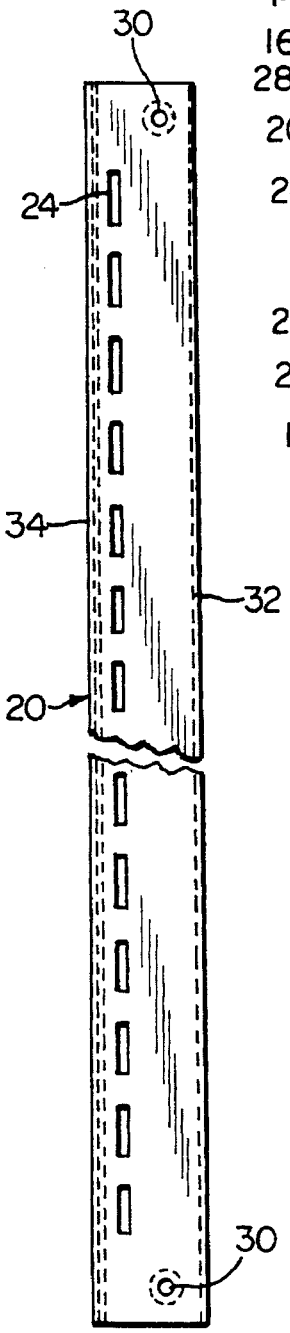
FIG. 2 is a front view, partially in section, of a shelf ladder constructed in accordance with the principles of the present invention.

As illustrated in FIG. 2, a plurality of apertures 30, provided in the shelf ladder 20, are adapted to receive the mounting screws 22. The apertures 30 are positioned closer to a first edge 32 of the shelf ladder 20 than to a second edge 34. The slots 24, however, are positioned closer to the second edge 34. Further, when the shelf ladder is positioned near a sidewall 16 of the liner, the slots 24 are vertically arranged along a vertical plane A between a vertical plane B of apertures 30 and a vertical plane C of the nearest side wall 16 illustrated as shown in FIG. 3.

Figure 3:
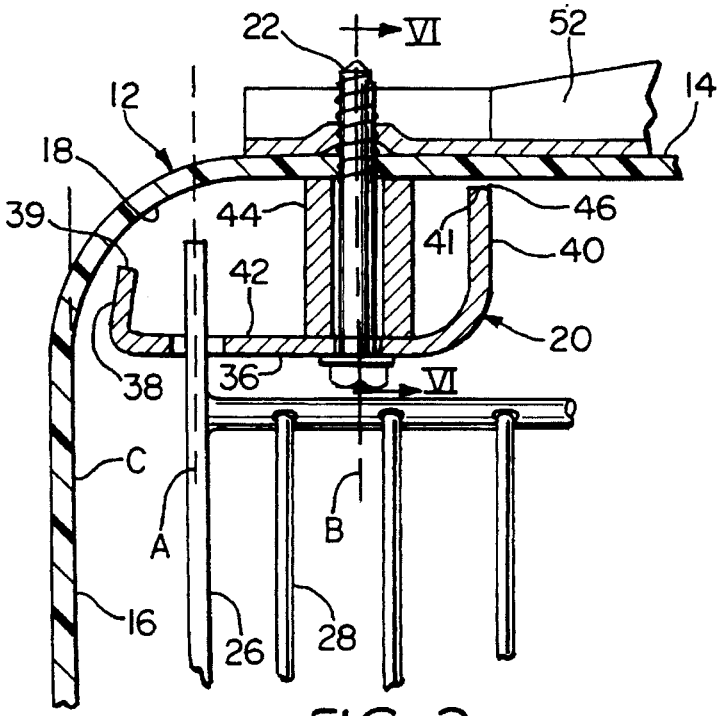
FIG. 3 is a top sectional view of a refrigeration appliance constructed in accordance with the principles of the present invention.
Figure 5:
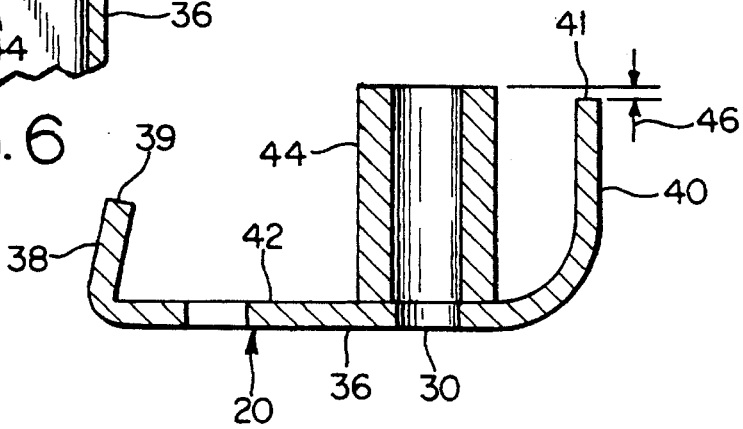
FIG. 5 is a top sectional view of the shelf ladder illustrated in FIG. 2.

As illustrated in FIGS. 3 and 5, the shelf ladder 20 includes a linear portion 36. Looking at the lateral cross section, at one edge of the linear portion is a hook portion or leg 38 and at the opposite edge there is a folded leg 40 such that the shelf ladder 20 has a generally U-shaped cross section. Both the hook portion 38 and the leg portion 40 have longitudinal edges 39 and 41, respectively. The hook portion 38 is bent back over the back side of the linear portion 36 so that the angle between the hook portion 38 and the back face 42 of the linear portion 36 is less than 90°. The leg portion 40 is formed at approximately 90° to the back face 42 of the linear portion 36.

Also, a spacer member 44 is attached to the back face 42 of the shelf ladder 20, preferably in the form of a thick walled cylindrical member. A length of the spacer 44 which extends away from the rear face 42 is greater than the rearward extension length of the leg 40 or hook portion 38. Thus, a gap 46 will be provided between an end of the leg 40 and the liner 12 to prevent any cutting engagement between the leg end and the liner.

The hook portion 38 extends rearwardly even less than the leg 40 in that it is to be received in the area of the rounded corner 18 of the liner. This shorter leg 38 should also be dimensioned to allow for a clearance gap between an end of the leg and the liner 12. The apertures 30 are provided through the linear portion 36, adjacent to and preferably within the spacer member 44 to provide access for a mounting screw 22.

Mounting screw 22 is arranged near the interior edge 32 of the shelf ladder 20, such that a screw anchor member 52 receives and secures the mounting screw 50 to a linear portion of the back wall 14 of the liner 12. The slots 24, illustrated in FIG. 2, are adapted to receive the brackets 26. The slots 24 are offset toward the second edge 34 of the ladder 20 in order to provide optimum shelf area for the shelf 28 mounted on the shelf ladder 20. Further, by offsetting the apertures 30 toward the first edge 32 of the ladder 20, the screw anchor member 52 on the rear of the back wall 14 of the liner 12 is able to be mounted to a flat area on the back wall 14 rather than in the rounded corner 18. This arrangement also provides for reversibility of the ladder 20. Thus, a shelf ladder 20 constructed in accordance with the principles of the present invention is reversible to fit either of the rounded rear corners 18 of the refrigeration appliance 10 with the slots 24 and the apertures 30 aligned on opposite sides of a longitudinal centerline of the shelf ladder 20.

Figure 4:
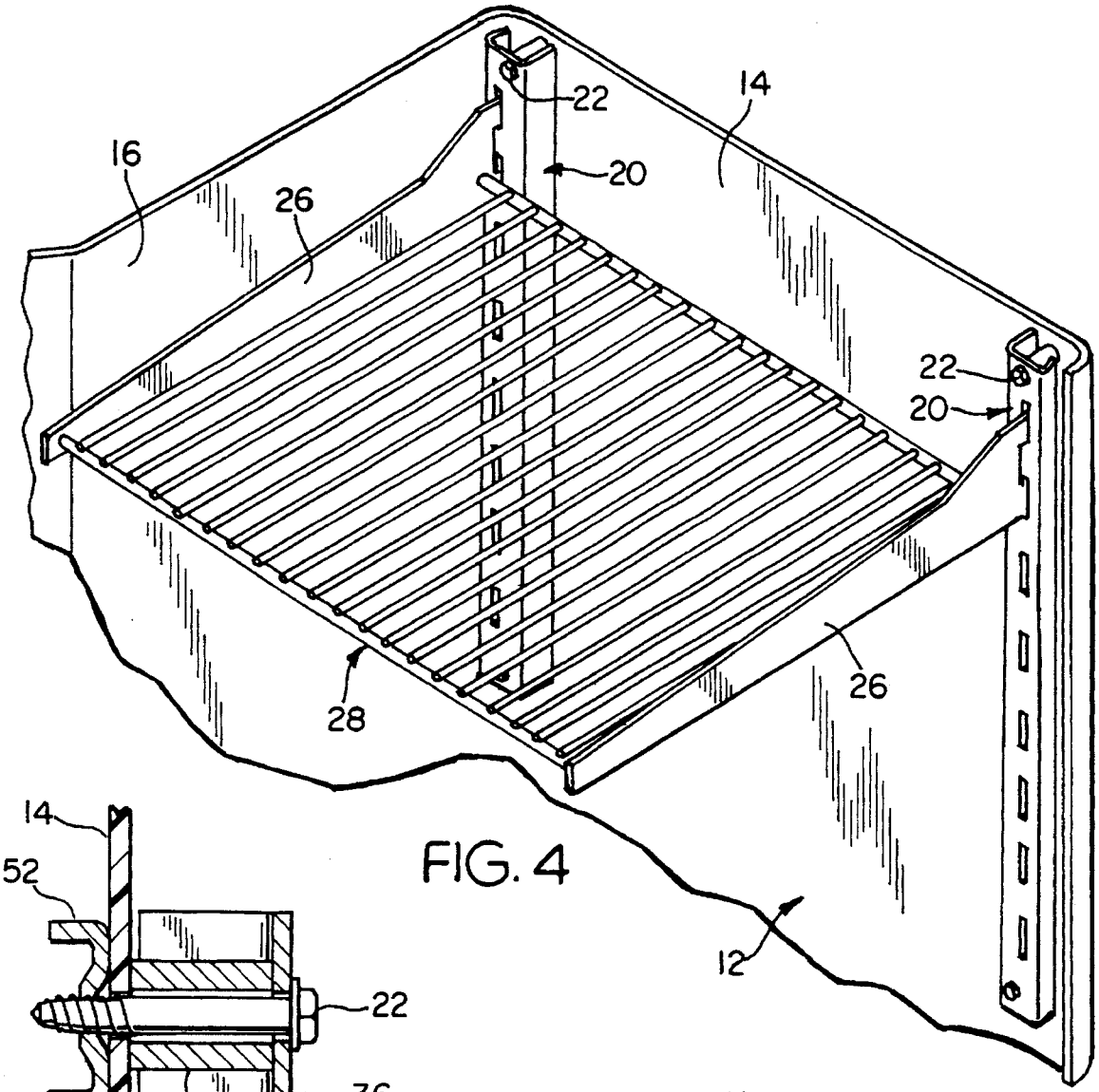
FIG. 4 is a top perspective view, partially in section, of a refrigeration appliance constructed in accordance with the principles of the present invention.
Figure 6:
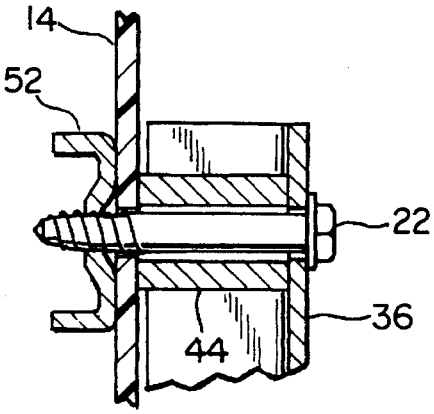
FIG. 6 is a side sectional view taken generally along line VI-VI of FIG. 3.

As illustrated in FIG. 4, a shelf ladder 20 constructed in accordance with the principles of the present invention permits the shelf area of the shelf 28 to be optimized within the refrigeration appliance 10 by presenting the side edge arms 26 of the shelf 28 as close to the side walls 16 of the liner 12 as possible.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiment of the invention in which an exclusive property or privilege is claimed are defined as follows:

1. An appliance comprising: a liner including a back wall, side walls, and rounded corners connecting said back wall to said side walls, said rounded corners defining 90° arc angle areas; and a ladder bracket including:

a linear portion having a first longitudinal edge, a second longitudinal edge and a vertical centerline, said linear portion positioned substantially parallel to said back wall, a leg portion extending from said first longitudinal edge of said linear portion toward said back wall, said leg portion being substantially perpendicular to said linear portion, said leg portion having a longitudinal terminal edge wherein said leg portion has a width measured from said first longitudinal edge to said longitudinal terminal edge, a hook portion extending from said second longitudinal edge of said linear portion toward said back wall a distance less than said width of said leg portion, said hook portion having a longitudinal terminal edge portion being received in said 90° arc angle areas of one of said rounded corners, a plurality of slots arranged in said linear portion laterally offset from said vertical centerline toward said hook portion, a plurality of apertures arranged in said linear portion laterally offset from said vertical centerline toward said leg portion, a plurality of spacer portion extending from said linear portion toward said back wall a distance greater than said width of said leg portion, said spacer portions being positioned adjacent said plurality of apertures; and a plurality of fasteners extending through said apertures and spacers for securing said ladder bracket to said back wall.

2. The appliance as in claim 1, further comprising;

a shelf having shelf mounting bracket for adjustably mounted to said slots on said ladder bracket wherein said slots support said shelf mounting bracket in said 90° arc angles areas of said rounded corners.

3. The appliance as claimed in claim 1, further wherein the distance from said longitudinal terminal edge portion of said hook portion to said linear portion is less than said width of said leg portion.

4. The appliance as claimed in claim 3, further wherein said hook portion extends at an angle from said linear portion to partially overlie said linear portion.

* * * * *